US006336398B1

(12) United States Patent
Kayser et al.

(10) Patent No.: US 6,336,398 B1
(45) Date of Patent: Jan. 8, 2002

(54) CALENDER FOR WEBS OF PAPER OR A SIMILAR MATERIAL

(75) Inventors: Franz Kayser, Geldern; Joachim Hinz, Kempen; Mathias Helmus, Tönisvorst; Gerhard Stock, Krefeld, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/353,631

(22) Filed: Jul. 15, 1999

(30) Foreign Application Priority Data

Jul. 16, 1998 (DE) ..... 198 32 066

(51) Int. Cl.[7] ..... B30B 3/04

(52) U.S. Cl. ..... 100/164; 100/161; 100/162 R; 100/162 B

(58) Field of Search ..... 100/160, 162 R, 100/162 B, 163 R, 163 A, 164, 168, 172; 72/241.6; 492/2, 5, 7

(56) References Cited

U.S. PATENT DOCUMENTS

| | | | | | |
|---|---|---|---|---|---|
| 3,728,767 | A | * | 4/1973 | Shirai | 492/7 |
| 3,802,044 | A | * | 4/1974 | Spillmann et al. | 492/5 |
| 3,997,952 | A | * | 12/1976 | Lehmann et al. | 492/2 |
| 4,194,446 | A | * | 3/1980 | Palovaara | 100/162 B |
| 4,198,905 | A | * | 4/1980 | Lehmann | 100/162 B |
| 4,366,752 | A | | 1/1983 | Koski | |
| 4,471,690 | A | * | 9/1984 | Yamaguchi et al. | 100/162 R |
| 4,497,246 | A | * | 2/1985 | Pav et al. | 100/162 R |
| 4,520,723 | A | * | 6/1985 | Pav et al. | 100/162 B |
| 4,852,229 | A | * | 8/1989 | Crouse | 492/7 |
| 4,960,046 | A | * | 10/1990 | Anstotz et al. | 100/162 R |
| 5,026,005 | A | * | 6/1991 | Ehrola | 100/162 B |
| 5,501,145 | A | * | 3/1996 | Fromm | 100/163 R |
| 5,590,593 | A | * | 1/1997 | Korhonen et al. | 100/162 B |
| 5,662,307 | A | | 9/1997 | Lentine | |
| 5,911,174 | A | * | 6/1999 | Cramer et al. | 100/162 R |
| 5,947,017 | A | | 9/1999 | Hartwich et al. | |

FOREIGN PATENT DOCUMENTS

| | | |
|---|---|---|
| BE | 674203 | 4/1966 |
| DE | 3004913 | 8/1981 |
| DE | 3119677 | 1/1982 |
| DE | 19633671 | 3/1998 |
| EP | 0661405 | 7/1995 |
| EP | 735185 | 10/1996 |
| EP | 822289 | 2/1998 |
| GB | 2049516 | 12/1980 |

OTHER PUBLICATIONS

R. Van Haag, "Einflussverhalten einer Nipcorect–Walze auf das Papierdickenquerprofil im Softkalander," (Influencing Behavior of a Nipcorrect Roll on Paper Thickness Cross Profile in a Soft Calender), Wochenblatt für Papierfabrikation (Paper Manufacturing Weekly) 14/15, 1996, with an English Language Translation.

* cited by examiner

*Primary Examiner*—Peter Vo
*Assistant Examiner*—Louis Huynh
(74) *Attorney, Agent, or Firm*—Greenblum & Bernstein, P.L.C.

(57) ABSTRACT

The present invention relates to a calendar for treating a material web. In an exemplary embodiment, first and second roll stacks have first and second deflection adjustment rolls on an end thereof, respectively. Each of the first and second deflection adjustment rolls has a sleeve lift, and a sleeve supported by a deflection adjustment device on a fixed bracket. The first and second deflection adjustment rolls are adjacent to each other to define an additional nip therebetween that can be at least partially closed by the sleeve lift. An effective direction of the deflection adjustment device of the first deflection adjustment roll alternatively points toward the first roll stack and the second deflection adjustment roll, and an effective direction of the deflection adjustment device of the second deflection adjustment roll alternatively points toward the second roll stack and the first deflection adjustment roll.

4 Claims, 2 Drawing Sheets

CALENDER FOR WEBS OF PAPER OR A SIMILAR MATERIAL

CROSS-REFERENCE TO RELATED APPLICATIONS

The present application claims priority under 35 U.S.C. §119 of German Patent Application No. 198 32 006.3, filed on Jul. 16, 1998, the disclosure of which is expressly incorporated by reference herein in its entirety.

BACKGROUND OF THE INVENTION

1. Field of the Invention

The present invention relates to a calendar for manufacturing webs of paper or a similar material. More specifically, the present invention relates to a calendar having two roll stacks, each having a deflection adjustment roll on at least one end, whose sleeve is supported by a deflection adjustment device on a fixed bracket.

2. Discussion of Background Information

In a known calender of this type, such as disclosed in DE 196 33 671 A1, two roll stacks of five rolls each are attached to a stanchion, one above the other, in a common vertical plane. The top roll and the bottom roll of each stack are deflection adjustment rolls. Each top roll is fixed to the stanchion. The bottom roll is fastened to a carriage that can be moved and loaded by a hydraulic cylinder. The roll sleeves are supported at their ends on the associated bracket. The bracket is fastened to either the stanchion or the carriage. There are also known deflection adjustment rolls of the sleeve lift type, for example, as disclosed in DE 30 04 913 C2. For these rolls, the roll sleeve is not supported on the bracket, but can be moved relative to the bracket so that the deflection adjustment device can be simultaneously used as a loading device.

SUMMARY OF THE INVENTION

The present invention a provides a calender that provides additional options for web treatment compared to the prior art.

In the present invention, as deflection adjustment roll of one roll stack and a deflection adjustment roll of a second roll stack are of the sleeve lift type. They are adjacent to each other, and can form an additional nip that can be closed by the sleeve lift. The effective direction of the deflection adjustment device alternatively points toward the associated roll stack or toward the other deflection adjustment roll.

If the effective direction is toward the associated roll stack, the calendar operates normally. However, if the effective direction is toward the other deflection adjustment roll, then an additional nip is formed, which can be used alone. If the two adjacent deflection adjustment rolls have an elastic cover, a matte satination is defined between the rolls. When manufacturing with the additional nip, the other rolls of the two roll stacks are not used, and can therefore be replaced or repaired. Thus, when one or more of the intermediary rolls needs to be repaired or replaced, the calendar can continue to operate using the adjacent deflection adjustment rolls.

Deflection adjustment devices are known in a wide variety of forms. For the most part, they function with hydrostatic support devices, particularly in the form of a series of support element that define the effective direction. It is therefore preferable that the deflection adjustment device of the present invention include a series of support elements, which can be moved through an angle (i.e., rotate) by an adjusting device. This minimizes the structural expense of the support device. In addition, a guide for the directed sleeve lift moves with the series of support elements.

As an alternative, the deflection adjustment device can include two series of support elements offset from each other. These support elements can be intentionally activated.

Preferably, the bearings for the bracket have at least one deflection adjustment roll cam with which the distance between adjacent deflection adjustment rolls can be changed. This cam can close the nip between the adjacent deflection rolls (the additional "nip") if the sleeve lift alone is insufficient.

Preferably, the cams, together with the bracket, can be rotated through an angle by the adjusting device. Only one adjusting device is, therefore, needed to adjust the bracket and cams.

The two roll stacks preferably have a common central plane. This allows a common guide to be used on the stanchion.

Preferably, the common central plane extends obliquely to the horizontal. The resulting calendar has a height less than a 10-roll calendar with a vertical roll stack, and a length less than two 5-roll calenders with vertical roll stacks arranged next to each other.

In an alternative, the central planes of the two roll stacks can form an angle, particularly an acute angle, in relation to each other.

Preferably, the roll stacks have an odd number of rolls, each nip is defined by a hard roll and an elastic roll, and the deflection adjustment rolls that define the additional nip have an elastic cover. When using both roll stacks, this produces a glossy satination of the paper in which the two sides of the web side alternatively rest against the hard, smooth rolls. A matte satination is produced when only the additional nip is used.

The above noted benefits are particularly realized with combinations of roll stacks having 3, 5, or 7 rolls. Two roll stacks with 5 roll are preferred because of a high degree of uniformity in the paper web treatment.

In an exemplary embodiment, first and second roll stacks have first and second deflection adjustment rolls on an end thereof, respectively. Each of the first and second deflection adjustment rolls has a sleeve lift, and a sleeve supported by a deflection adjustment device on a fixed bracket. The first and second deflection adjustment rolls are adjacent to each other to define an additional nip therebetween that can be at least partially closed by the sleeve lift. An effective direction of the deflection adjustment device of the first deflection adjustment roll alternatively points toward the first roll stack and the second deflection adjustment roll, and an effective direction of the deflection adjustment device of the second deflection adjustment roll alternatively points toward the second roll stack and the first deflection adjustment roll.

According to a feature of the above embodiment, the deflection adjustment device of the first and second deflection adjustment rolls has a series of supporting elements that can be rotated by an adjusting device. Bearings for the bracket have at least one cam that can change a distance between the first and second deflection adjustment rolls. The adjusting device rotates the cam and the bracket.

In another feature of the above embodiment, the first and second roll stacks have a substantially common central plane, which preferably extends obliquely to a horizontal plane.

The first and second roll stacks may each have an odd number of rolls of alternative hard rolls and elastic rolls to define a plurality of nips therebetween, and the first and second deflection adjustment rolls have an elastic cover. The odd number is preferably 5.

According to another embodiment of the invention, a calendar for treating a material web includes first and second roll stacks having adjacent first and second deflection adjustment rolls on an end thereof, respectively, to define an additional nip therebetween. Each of the first and second deflection adjustment rolls have a deflection adjustment device. An adjusting device can move each of the deflection adjustment devices of the first and second deflection adjustment rolls to a first position in which an effective direction of each of the deflection adjustment devices of the first and second deflection adjustment rolls is toward the first and second roll stacks, respectively, and a second position in which the effective direction is toward the second and first deflection adjustment rolls, respectively. A closing device can open and close the additional nip when the deflection adjustment devices of the first and second deflection adjustment rolls are in the second position.

The deflection adjustment devices of the first and second deflection adjustment rolls preferably have a series of supporting elements that can be rotated by the adjusting device. The adjusting device includes bearings on a bracket having at least one cam that can change a distance between the first and second deflection adjustment rolls. The adjusting device rotates the cam and the bracket.

According to various features of the above embodiment, the first and second roll stacks preferably have a substantially common central plane. The substantial common central plane extends obliquely to a horizontally plane. The first and second roll stacks each have an odd number of rolls (preferably 5) of alternative hard rolls and elastic rolls to define a plurality of nips therebetween, and the first and second deflection adjustment rolls have an elastic cover.

A method for operating a calender is also provided. The calender includes first and second roll stacks having adjacent first and second deflection adjustment rolls on an end thereof, respectively, to define an additional nip there between. Each of the first and second deflection adjustment rolls have deflection adjustment device. The method includes moving each of the deflection adjustment devices of the first and second deflection adjustment rolls to a first position in which an effective direction of each of the deflection adjustment devices of the first and second deflection adjustment rolls is toward the first and second roll stacks, respectively, whereby the calendar can perform a first operation on the web. Each of the deflection adjustment devices of the first and second deflection adjustment rolls are moved to a second position in which the effective direction is toward the second and first deflection adjustment rolls, respectively. The first and second deflection adjustment rolls are moved toward each other to close the additional nip, whereby the calendar can perform a second operation on the web, the second operation being different from the first operation.

Moving each of the deflection adjustment devices of the first and second deflection adjustment rolls to the first position and moving each of the deflection adjustment devices of the first and second deflection adjustment rolls to the second position preferably includes rotating, by 180°, each of the deflection adjustment devices of the first and second deflection adjustment rolls.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE EXEMPLARY EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
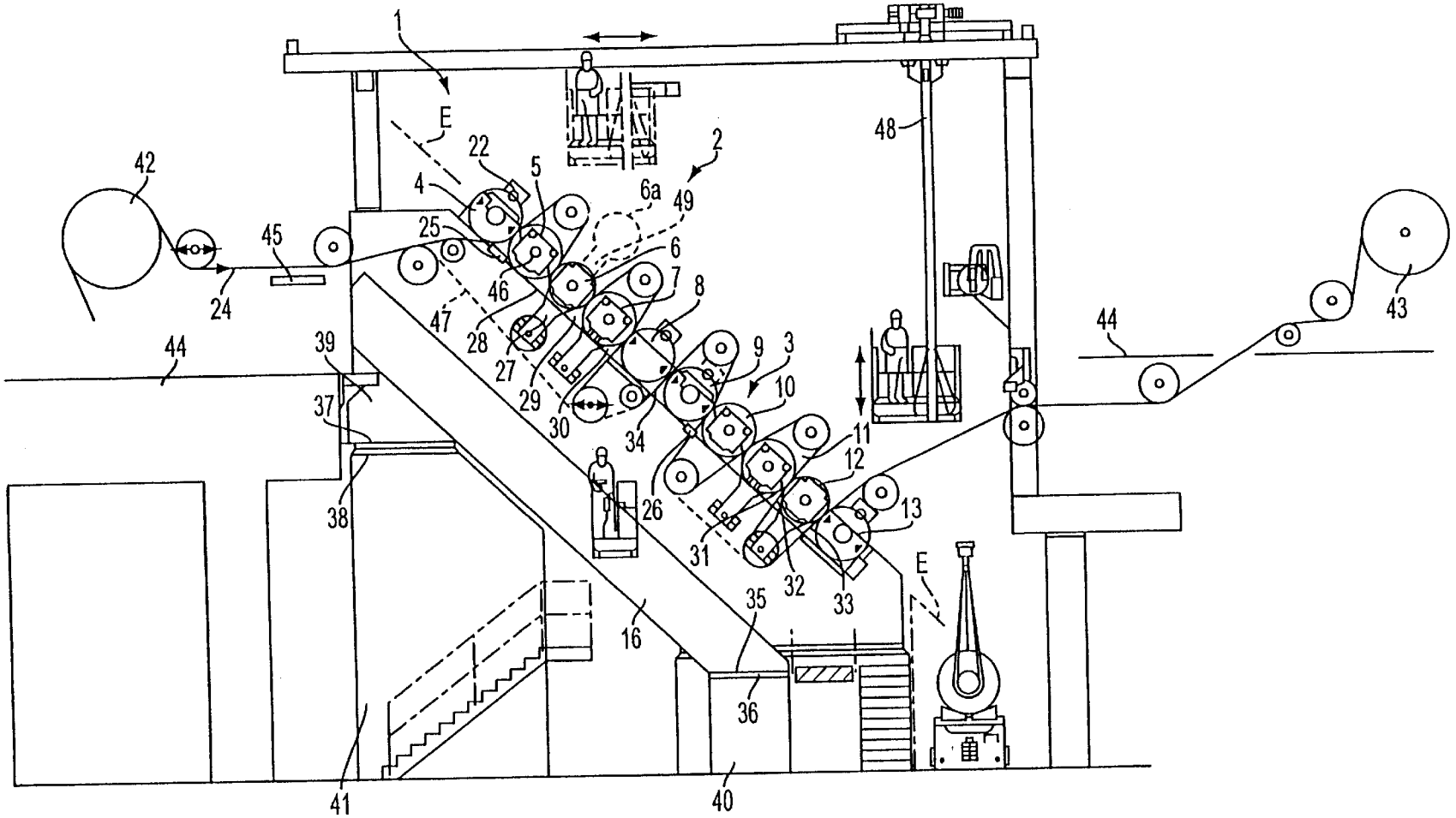
FIG. 1 is a schematic side view of a calender according to the invention.

Referring now to FIG. 1, a calender 1 has an upper 5-roll stack 2 and a lower 5-roll stack 3. The upper roll stack 2 includes a top roll 4, three intermediary rolls 5, 6, and 7, and a bottom roll 8. The lower roll stack 3 includes a top roll 9, three intermediary rolls 10, 11, and 12, and a bottom roll 13.

Figure 2:
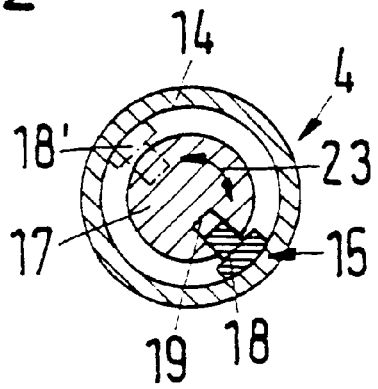
FIG. 2 is a cross-section through the central region of a deflection adjustment roll.
Figure 3:
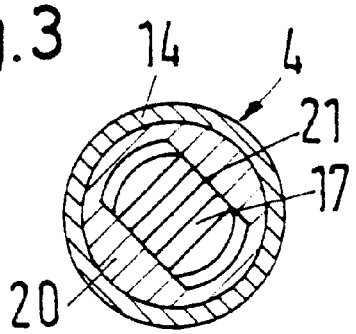
FIG. 3 is a cross-section through the end region of a deflection adjustment roll.

The top and bottom rolls 4, 8, 9, and 13 are deflection adjustment rolls of the sleeve lift type. These rolls can have the same structure as one another so that one reserve roll suffices for all four end rolls. Referring now also to FIGS. 2 and 3, each deflection adjustment roll has a sleeve 14, which is supported by a deflection adjustment device 15 on a bracket 17 that is fixedly secured to the stanchion 16 during operation. The deflection adjustment device 15 includes a series of hydrostatic support elements 18, which are supplied in a known manner with pressure fluid via a respective pressure chamber 19 such that the deflection adjustment device 15 is also used as a loading device. At the ends, the roll sleeve 14 is supported on a bearing ring 20, which can be moved over its entire length in a lift direction on a lift guide 21. In addition, bracket 17 can be rotated by an angle of 180° along the direction indicated by arrow 23 by an adjusting device 22 so that the effective direction of the deflection adjustment device 15 points in the opposite direction, as shown by the series of support elements 18' depicted with dashed lines.

The uppermost intermediary rolls 5 and 10 are mounted fixedly on the stanchion 16. With the accompanying top rolls 4 and 9, if the defection adjustment device 15 is in the position shown in FIG. 2, the paper web 24 is subject to a very high line load, with a corresponding high compressive stress in the nips 25 and 26 of the upper roll stack 2 or the lower roll stack 3 that are first in the running direction.

The intermediary rolls 6, 7, 11, and 12 are each supported on a lever 27, which pivots around a pivot axle fixed to the stanchion. If the deflection adjustment devices 15 of the bottom rolls 8 and 13 are in the position shown with dashed lines in FIG. 2, the nips 28, 29, and 30 of the upper roll stack 2 and the nips 31, 32, and 33 of the lower roll stack 3 are correspondingly loaded. The level of loading is independent of nips 25 or 26. Four sections are therefore produced in which the paper web 24 can be treated differently, so that a large number of different paper qualities can be produced.

During normal operation, an open additional nip 34 remains between the two roll stacks 2 and 3, through which the paper web 24 travels unhindered. Preferably, one side of the web is satinated in the upper roll stack 2, and the other side of the web is satinated in the lower roll stack 3.

The top and bottom rolls 4, 8, 9, and 13, as well as the intermediary rolls 7 and 11 are elastic rolls, while the remaining intermediary rolls 5, 7, 10, and 12 are heated, hard rolls. However, other combinations may be used.

The distance between the two deflection adjustment rolls 9 and 10 is slight so that the additional nip 34 can be closed, for example by 30–40 mm, with the roll lift. To this end, it is only necessary to rotate the deflection adjustment devices 15 of the two end rolls 8 and 9 toward each other with the aid of the adjusting device 22, and to then supply the pressure fluid under appropriate pressure. A matte satination can then be carried out using this additional nip 34, since the two deflection adjustment rolls 8 and 9 have an elastic cover. Therefore, this provides an additional way to treat the paper web without significant additional cost.

Figure 4:
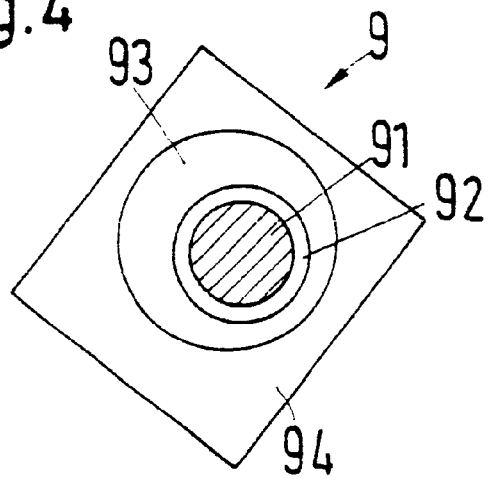
FIG. 4 is a schematic representation of the bearing of the bracket of a deflection adjustment roll.

Referring now also to FIG. 4, if the open additional nip 34 is so large that sleeve lift cannot close it, then the bracket 91 of the top roll 9 can be supported in a dome 92, which is in turn carried by a cam disk 93. Cam disk 93 can be rotated, together with the bracket 91, by 180° in the bearing 94 by the adjusting device 22. In this manner, the open additional nip 34 can be reduced, for example, by 80 mm, which also opens nips 28 and 29.

The axes of the rolls 4 to 13 are arranged generally in a common place E, which is preferably inclined by 45° to the horizontal. The stanchion 16 also extends obliquely. It can therefore be supported at two points, namely with a lower support face 35 on a lower bearing face 36 that is fixed to the building, and with an upper support face 37 on an upper bearing face 38 that is fixed to the building. The bearing face 37 is arranged on a foot 39 that is attached to the stanchion 16 close to its upper end. The bearing faces 36 and 38 extend horizontally and are each embedded on a concrete pedestal or footing 40 or 41. The stanchion 16 is thus largely insensitive to vibrations.

In FIG. 1, calender 1 is arranged between the last drying roll 42 of a drying section of a paper machine and a winding device 43, for example, a roll cutting and winding device. The drying roll and the winding device are arranged approximately at the same height above a working plane 44 of calender 1. The paper web 24 extends at a relatively slight incline between the drying roll 42 and the entry into the calendar 1, as well as between the exit from the calender 1 and the winding device 43. This facilities the insertion of the paper web during online operation. The same advantage is also realized when the paper web is introduced from the drying roll 42 into the calendar 1 from below and exits at the top toward the winding device 43.

A web feeder device 45, which functions, for example, with cable clamping, conveys web 24 through all of the nips 25–33 of the two roll stacks 2 and 3, as well as the additional nip 34. One insertion procedure is therefore sufficient for both roll stacks. The insertion movement is aided by virtue of the fact that each of the rolls of calendar 1 and each of the associated guide rolls has a respective drive 46. Paper treatment proceeds depending on which of the nips are closed.

A second web inserting device 47 is shown with dashed lines, which supplies only the additional nip 34. With the matte satination of a web inserted in this manner, the remaining rolls can be repaired or replaced. A semi-matte operation is produced, for example, when only the uppermost nip 25 is used.

The precise inclination of the stanchion 16 is a function of on-site conditions. Plus or minus 10° from 45° fall within the preferred range, although other angles are possible.

The oblique inclination with the roll stacks arranged on top has the additional advantage that, for the purpose of exchanging rolls, they can be better accessed and exchanging using a crane 48 and a corresponding crane control. In particular, the bearings of the roll to be changed can be moved out along a guide perpendicular to the plane E, as shown with dashed lines in FIG. 1, by a hydraulic adjusting device 49. The piston of a hydraulic cylinder that extends along the lever 27 is primarily used by the adjusting device 49. In the outside position, the crane 48 can directly grasp the roll ends and remove the roll vertically.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender for treating a material web, comprising:

a first roll stack having a first deflection adjustment roll on an end of said first roll stack, and a second roll stack having a second deflection adjustment roll on an end of said second roll stack;

each of said first and second deflection adjustment rolls having a sleeve lift, and a sleeve supported by a deflection adjustment device on a bracket;

said first and second deflection adjustment rolls being adjacent to each other to define an additional nip therebetween that can be at least partially closed by said sleeve lift, wherein an effective direction of said deflection adjustment device of said first deflection adjustment roll alternatively points toward said first roll stack and said second deflection adjustment roll, and an effective direction of said deflection adjustment device of said second deflection adjustment roll alternatively points toward said second roll stack and said first deflection adjustment roll, wherein said deflection adjustment device of said first and second deflection adjustment rolls has a series of supporting elements that can be rotated by an adjusting device, and wherein bearings for said bracket have at least one cam which can change a distance between said first and second deflection adjustment rolls.

2. The calender of claim 1, wherein said adjusting device rotates said cam and said bracket.

3. A calender for treating a material web, comprising:

a first roll stack having a first deflection adjustment roll on an end of said first roll stack, and a second roll stack having a second deflection adjustment roll on an end of said second roll stack, said first and second deflection adjustment rolls being adjacent to define an additional nip therebetween;

each of said first and second deflection adjustment rolls having a deflection adjustment device;

adjusting device capable of moving each of said deflection adjustment devices of said first and second deflection adjustment rolls to a first position in which an effective direction of each of said deflection adjustment devices of said first and second deflection adjustment rolls is toward said first and second roll stacks, respectively, and a second position in which said effective direction is toward said second and first deflection adjustment rolls, respectively;

a closing device capable of opening and closing said additional nip when said deflection adjustment devices of said first and second deflection adjustment rolls are in said second position, wherein said adjusting device comprises bearings on a bracket having at least one cam which can change a distance between said first and second deflection adjustment rolls.

4. The calendar of claim 3, wherein said adjusting device rotates said cam and said bracket.

* * * * *